US008845862B2

(12) United States Patent
Shirao et al.

(10) Patent No.: US 8,845,862 B2
(45) Date of Patent: Sep. 30, 2014

(54) DEVICE FOR PRODUCING FIBROUS SHEET

(75) Inventors: Takeshi Shirao, Tokyo (JP); Mitsuru Tsunoda, Tokyo (JP); Hiroki Sato, Nichinan (JP); Takashi Kawamukai, Tokyo (JP)

(73) Assignee: Oji Holdings Corporation, Tokyo (JP)

( * ) Notice: Subject to any disclaimer, the term of this patent is extended or adjusted under 35 U.S.C. 154(b) by 0 days.

(21) Appl. No.: 13/993,456

(22) PCT Filed: Dec. 16, 2011

(86) PCT No.: PCT/JP2011/079192

§ 371 (c)(1),
(2), (4) Date: Jun. 12, 2013

(87) PCT Pub. No.: WO2012/081698

PCT Pub. Date: Jun. 21, 2012

(65) Prior Publication Data

US 2013/0269898 A1 Oct. 17, 2013

(30) Foreign Application Priority Data

Dec. 17, 2010 (JP) ..... 2010-282381

(51) Int. Cl.

| | |
|---|---|
| ***D21F 9/00*** | (2006.01) |
| ***D21F 1/00*** | (2006.01) |
| ***D21F 1/48*** | (2006.01) |
| ***D21F 1/56*** | (2006.01) |
| ***D21F 1/80*** | (2006.01) |

(52) U.S. Cl.

CPC ..... *D21F 9/00* (2013.01); *D21F 1/0027* (2013.01); *D21F 1/48* (2013.01); *D21F 1/56* (2013.01); *D21F 1/80* (2013.01)

USPC ..... 162/289; 162/308; 162/320; 162/323; 162/334; 162/348; 162/350; 162/353; 162/354; 162/363; 162/375

(58) Field of Classification Search

CPC ..... D21F 1/0027; D21F 3/0227; D21F 9/00; D21F 1/48; D21F 9/02; D21F 11/02; D21F 1/02; D21F 1/365; D21F 1/56; D21F 1/80

USPC ..... 162/265–267, 289, 291, 297, 300–302, 162/308, 311, 320, 323, 334, 348–350, 162/353–354, 363, 375

See application file for complete search history.

(56) References Cited

U.S. PATENT DOCUMENTS 1,514,011 A * 11/1924 Pope ..... 162/279
1,577,897 A * 3/1926 Alois ..... 162/211

(Continued)

FOREIGN PATENT DOCUMENTS

CN 1409787 A 4/2003
CN 1914374 A 2/2007

(Continued)

OTHER PUBLICATIONS

EPO Machine Translation of the First office Action on Application/Publication No. CN-201180060361.X, issued on Jul. 15, 2014.*

(Continued)

*Primary Examiner* — Jose Fortuna

(74) *Attorney, Agent, or Firm* — Knobbe Martens Olson & Bear LLP

(57) ABSTRACT

A device for producing a fibrous sheet, including a water squeezing section which squeezes the dispersion medium from a dispersion to generate a web, and a drying section which dries the web to generate a fibrous sheet, the water squeezing section having multiple first fabric sheets arranged longitudinally along the transport direction of a web substrate that is partway through web generation, and water squeezing units which are provided beneath the multiple first fabric sheets and squeeze the dispersion medium from the dispersion, and in the water squeezing section, a continuous sheet is positioned so as to extend over the upper surface of the multiple first fabric sheets, and the dispersion is discharged onto the upper surface of the continuous sheet.

14 Claims, 7 Drawing Sheets

(56) References Cited

U.S. PATENT DOCUMENTS

| | | | | | |
|---|---|---|---|---|---|
| 1,754,370 | A | * | 4/1930 | Raynes | 162/298 |
| 2,392,150 | A | * | 1/1946 | Hornbostel et al. | 162/252 |
| 2,870,819 | A | * | 1/1959 | Heyman | 264/86 |
| 2,881,677 | A | * | 4/1959 | Reginald | 162/203 |
| 3,013,605 | A | * | 12/1961 | Justus | 162/349 |
| 3,082,819 | A | * | 3/1963 | Justus et al. | 162/349 |
| 3,115,439 | A | * | 12/1963 | Austin | 162/367 |
| 3,127,308 | A | * | 3/1964 | Justus et al. | 162/349 |
| 3,222,246 | A | * | 12/1965 | Lee | 162/349 |
| 3,330,723 | A | * | 7/1967 | Henrik | 162/208 |
| 3,399,111 | A | * | 8/1968 | Beaumont et al. | 162/199 |
| 3,477,905 | A | * | 11/1969 | Rogers, Jr. | 162/203 |
| 3,480,509 | A | * | 11/1969 | Stein | 162/309 |
| 3,560,334 | A | * | 2/1971 | Ardledter | 162/266 |
| 3,642,573 | A | * | 2/1972 | Genz et al. | 162/311 |
| 3,650,892 | A | * | 3/1972 | Genz et al. | 162/275 |
| 3,676,294 | A | * | 7/1972 | Opderbeck et al. | 162/192 |
| 3,764,465 | A | * | 10/1973 | Bartley et al. | 162/351 |
| 3,775,244 | A | * | 11/1973 | Hubschmann | 162/351 |
| 3,785,922 | A | * | 1/1974 | Keller | 162/299 |
| 3,846,233 | A | * | 11/1974 | Kankaanpaa | 162/312 |
| 3,876,500 | A | * | 4/1975 | Csordas et al. | 162/274 |
| 3,907,635 | A | * | 9/1975 | Bringman | 162/211 |
| 4,306,934 | A | * | 12/1981 | Seppanen | 162/209 |
| 4,780,184 | A | * | 10/1988 | Salovaara | 162/208 |
| 5,011,575 | A | * | 4/1991 | Keller | 162/299 |
| 5,034,100 | A | * | 7/1991 | Sides | 162/306 |
| 5,622,599 | A | * | 4/1997 | Sproule et al. | 162/186 |
| 6,123,882 | A | * | 9/2000 | Uchida et al. | 264/87 |
| 6,413,674 | B1 | | 7/2002 | Mizobuchi et al. | |
| 7,597,779 | B2 | * | 10/2009 | Gupta et al. | 162/156 |
| 8,070,916 | B2 | * | 12/2011 | Scherb et al. | 162/263 |
| 8,157,965 | B2 | * | 4/2012 | Saito | 162/263 |
| 2002/0096302 | A1 | * | 7/2002 | Scherb et al. | 162/358.1 |
| 2004/0163787 | A1 | * | 8/2004 | Bartelmuss et al. | 162/274 |
| 2005/0098282 | A1 | * | 5/2005 | Scherb | 162/123 |
| 2005/0133186 | A1 | * | 6/2005 | Hultcrantz | 162/358.1 |
| 2005/0167062 | A1 | * | 8/2005 | Herman et al. | 162/115 |
| 2007/0068645 | A1 | * | 3/2007 | Silva | 162/289 |
| 2010/0300635 | A1 | * | 12/2010 | Mausser et al. | 162/199 |
| 2013/0025809 | A1 | * | 1/2013 | Godsay et al. | 162/210 |
| 2013/0269898 | A1 | * | 10/2013 | Shirao et al. | 162/375 |

FOREIGN PATENT DOCUMENTS

| | | | | | |
|---|---|---|---|---|---|
| DE | 2345984 | A1 | * | 3/1975 | |
| DE | 3635889 | A1 | * | 4/1987 | |
| EP | 0043290 | A1 | | 1/1982 | |
| EP | 774541 | A1 | * | 5/1997 | D21F 9/02 |
| EP | 2017384 | A2 | * | 1/2009 | D21F 9/02 |
| FR | 1179729 | | | 5/1959 | |
| FR | 1218040 | | | 5/1960 | |
| JP | A-57-039300 | | | 3/1982 | |
| JP | A-60-167990 | | | 8/1985 | |
| JP | A-63-112790 | | | 5/1988 | |
| JP | A-10-140493 | | | 5/1998 | |
| JP | A-2008-274525 | | | 11/2008 | |
| JP | 2012132103 | A | * | 7/2012 | |
| JP | 2013096026 | A | * | 5/2013 | |

OTHER PUBLICATIONS

International Search Report mailed on Feb. 28, 2012 in International Application No. PCT/JP2011/079192.

Extended European Search Report mailed May 26, 2014 in European Application No. 11849094.5.

Office Action issued in Chinese Patent Application No. 201180060361.X on Jul. 15, 2014.

* cited by examiner

DEVICE FOR PRODUCING FIBROUS SHEET

TECHNICAL FIELD

The present invention relates to a device for producing a fibrous sheet.

The present application claims priority on Japanese Patent Application No. 2010-282381, filed Dec. 17, 2010, the content of which is incorporated herein by reference.

BACKGROUND ART

Devices that convert a fibrous sheet composed of an aggregation of fibers into a nonwoven fabric form or paper-like form using a wet papermaking method are already known. The device for producing this fibrous sheet is equipped with a water squeezing section which squeezes the dispersion medium from a dispersion containing the fibers to generate a web, a drying section which dries the web to generate a fibrous sheet, and a winding section for winding the fibrous sheet (for example, see Japanese Unexamined Patent Application, First Publication No. 2008-274525).

A wire mesh (hereafter referred to as a "fabric sheet") is provided in the water squeezing section. In the water squeezing section, by running the fabric sheet while discharging the dispersion onto the upper surface of the sheet, thereby separating the dispersion medium through the pores in the fabric sheet, the dispersion medium is squeezed from the dispersion to generate a web.

However, in recent years, in the development of fibrous sheets, a reduction in the pore diameter and an increase in the porosity of the fibrous sheet are being demanded.

For example, electrical storage devices such as batteries and capacitors exhibit electrical storage performance by moving an electrolyte between a positive electrode and a negative electrode. In order to prevent short-circuits between the positive and negative electrodes in these electrical storage devices, a separator formed from a fibrous sheet is disposed between the positive and negative electrodes.

Here, in order to improve the electrical storage performance of the electrical storage devices, it is necessary to facilitate the movement of the electrolyte while preventing short-circuits between the positive and negative electrodes. In order to prevent short-circuits between the positive and negative electrodes, a reduction in the pore diameter is required for the fibrous sheet that constitutes the separator. Further, in order to facilitate the movement of the electrolyte, an increase in the porosity is required for the fibrous sheet that constitutes the separator.

Reducing the pore diameter and increasing the porosity of the fibrous sheet is achieved by producing a fibrous sheet using fine fibers. For example, nanofiber cellulose or the like is used as the fine fibers.

DISCLOSURE OF THE INVENTION

Problems to be Solved by the Invention

The water retention properties of fine fibers is generally extremely high. As a result, in the water squeezing section, it is necessary to lengthen the travelling distance of the fabric sheet used for separating the dispersion medium, so that the dispersion medium is squeezed from the dispersion containing the fine fibers over a long period of time.

However, if the fabric sheet is lengthened, the following types of problems occur.

In the water squeezing section, a suction pump is usually disposed beneath the fabric sheet. Then, the vacuum pressure difference and the like provided by the suction pump is used to squeeze the dispersion medium through the pores in the fabric sheet. As a result, the fabric sheet is suctioned toward the suction pump, and therefore if the travelling distance of the fabric sheet is lengthened, a large frictional force will act on the fabric sheet. Then, if the fabric sheet is run with the sheet pulled with a strong tension in order to counteract this frictional force, then there is a possibility that the fabric sheet may undergo slipping, or suffer damage such as stretching or rupture. In contrast, if the vacuum pressure is lowered to enable the tension to be weakened, then the amount of dewatering decreases, and there is a possibility that the basis weight may decrease.

Accordingly, the present invention has an object of providing a device for producing a fibrous sheet that enables production of a fibrous sheet while preventing damage to the fabric sheet.

Means to Solve the Problems

In order to achieve the above object, a device for producing a fibrous sheet according to the present invention is a device for producing a fibrous sheet from a dispersion containing fine fibers, the device including a water squeezing section which squeezes the dispersion medium from the dispersion to generate a web, and a drying section which dries the web to generate a fibrous sheet, wherein the water squeezing section has a plurality of first fabric sheets arranged longitudinally along the transport direction of a web substrate that is partway through web generation, and water squeezing units which are provided beneath the plurality of first fabric sheets and squeeze the dispersion medium from the dispersion, and in the water squeezing section, a continuous sheet is positioned so as to extend over the upper surface of the plurality of first fabric sheets, and the dispersion is discharged onto the upper surface of the continuous sheet.

According to the present invention, because the plurality of first fabric sheets are arranged longitudinally, when the dispersion medium is squeezed from the dispersion, the frictional force that acts on the first fabric sheets can be dispersed across the plurality of first fabric sheets. As a result, the first fabric sheets can be run without pulling the first fabric sheets with a strong tension. Accordingly, a fibrous sheet can be produced while preventing slipping and damage of the first fabric sheets.

Further, because the continuous sheet is positioned so as to extend over the upper surface of the plurality of first fabric sheets, in the water squeezing section, the frictional force during squeezing causes the lower surface of the continuous sheet and the upper surface of the first fabric sheets to adopt a state of close contact. When the first fabric sheets are run in this state, the continuous sheet is transported by the first fabric sheets. As a result, the continuous sheet can be transported without having to pull the continuous sheet with a strong tension. Accordingly, a fibrous sheet can be produced while preventing slipping and damage of the continuous sheet.

Moreover, according to this device configuration, the web substrate that is partway through web generation is transported between the plurality of first fabric sheets in a state mounted on the upper surface of the continuous sheet, and therefore damage of the web substrate during transfer between the plurality of first fabric sheets can be avoided. Accordingly, a fibrous sheet formed from fine fibers can be produced reliably.

In one aspect of the present invention, the continuous sheet is a second fabric sheet.

According to this aspect of the present invention, the dispersion medium can be squeezed from the dispersion through the pores in the second fabric sheet.

Further, because the second fabric sheet can be run without pulling the second fabric sheet with a strong tension, slipping and damage of the second fabric sheet can be prevented.

In another aspect of the present invention, the continuous sheet is composed of a filter material for papermaking disposed on the upper surface of the second fabric sheet.

According to this aspect of the present invention, by installing a filter material for papermaking having smaller pores than the second fabric sheet, finer fibers can be trapped. Accordingly, a further reduction in the pore diameter and a further increase in the porosity of the fibrous sheet can be achieved.

Further, because the filter material for papermaking can be run together with the second fabric sheet without having to pull the filter material for papermaking with a strong tension, damage to the second fabric sheet and the filter material for papermaking can be prevented.

In another aspect of the present invention, the continuous sheet may use a filter material for papermaking instead of the second fabric sheet. In this case, because the strength of the filter material for papermaking is weak, it is preferable that the filter material is supported by rollers or the like between the first fabric sheets.

In another aspect of the present invention, the water squeezing section has side walls which stand upward facing each other so as to extend along the aforementioned transport direction at both outside edges of the continuous sheet in a direction orthogonal to the transport direction, and is provided with a side sealing mechanism that blocks the gaps between the edges of the continuous sheet and the side walls.

According to this aspect of the present invention, the side sealing mechanism can prevent leakage of the dispersion onto the first fabric sheets and the water squeezing units from gaps between the edges of the continuous sheet and the side walls. Accordingly, the continuous sheet can trap fine fibers, and the dispersion medium can be squeezed out with good efficiency.

In another aspect of the present invention, the first fabric sheets are endless belts.

According to this aspect of the present invention, by forming the first fabric sheets as endless belts, the device for producing fibrous sheets can be made more compact.

In another aspect of the present invention, a drying section which dries the web to generate a fibrous sheet is provided downstream from the water squeezing section, and the second fabric sheet extends from the water squeezing section across to the drying section.

According to this aspect of the present invention, because there is no necessity to transfer the web from the water squeezing section to the drying section, even if the strength of the web weakens due to the use of fine fibers, damage of the web during transfer can be avoided. Accordingly, a fibrous sheet formed from fine fibers can be produced reliably.

In another aspect of the present invention, panel strips that contact the lower surface of the first fabric sheets are provided on the upper side of the water squeezing units, and through-holes are formed in the panel strips.

According to this aspect of the present invention, because the panel strips having through-holes formed therein contact the lower surface of the first fabric sheets, when the first fabric sheets are run, the lower surface of the first fabric sheets is swept clean by the edges of the through-holes. As a result, the dispersion medium that has passed through the pores of the first fabric sheets can be rapidly removed, and therefore the squeezing operation can be made more efficient.

In another aspect of the present invention, the plurality of first fabric sheets in the water squeezing section are arranged so that the heights of the first fabric sheets increase from the upstream side to the downstream side in the transport direction.

According to this aspect of the present invention, by arranging the first fabric sheets so that the heights of the fabric sheets increase from the upstream side to the downstream side, the web substrate can be gently lifted and pulled out of the deeply accumulated dispersion at the upstream side. Accordingly, a well-formed fibrous sheet having a smooth surface can be produced.

In another aspect of the present invention, the water squeezing section has a solvent application unit which applies a solvent that forms cavities in the fibrous sheet to the web substrate.

According to this aspect of the present invention, a porous fibrous sheet can be produced.

In other words, the present invention relates to the following.

(1) A device for producing a fibrous sheet from a dispersion containing fine fibers, the device including a water squeezing section which squeezes the dispersion medium from the dispersion to generate a web, and a drying section which dries the web to generate a fibrous sheet, wherein the water squeezing section has a plurality of first fabric sheets arranged longitudinally along the transport direction of a web substrate that is partway through web generation, and water squeezing units which are provided beneath the plurality of first fabric sheets and squeeze the dispersion medium from the dispersion, and in the water squeezing section, a continuous sheet is positioned so as to extend over the upper surface of the plurality of first fabric sheets, and the dispersion is discharged onto the upper surface of the continuous sheet.

(2) The device for producing a fibrous sheet disclosed in (1), wherein the continuous sheet is a second fabric sheet.

(3) The device for producing a fibrous sheet disclosed in (1), wherein the continuous sheet is composed of a filter material for papermaking disposed on the upper surface of a second fabric sheet.

(4) The device for producing a fibrous sheet disclosed in any one of (1) to (3), wherein the water squeezing section has side walls which stand upward facing each other so as to extend along the aforementioned transport direction at both outside edges of the continuous sheet in a direction orthogonal to the transport direction, and a side sealing mechanism is provided which blocks the gaps between the edges of the continuous sheet and the side walls.

(5) The device for producing a fibrous sheet disclosed in any one of (1) to (4), wherein the first fabric sheets are endless belts.

(6) The device for producing a fibrous sheet disclosed in any one of (1) to (5), wherein a drying section which dries the web to generate the fibrous sheet is provided downstream from the water squeezing section, and the continuous sheet extends from the water squeezing section across to the drying section.

(7) The device for producing a fibrous sheet disclosed in any one of (1) to (6), wherein panel strips that contact the lower surface of the first fabric sheets are provided on the upper side of the water squeezing units, and through-holes are formed in the panel strips.

(8) The device for producing a fibrous sheet disclosed in any one of (1) to (7), wherein the plurality of first fabric sheets in the water squeezing section are arranged so that the heights of the first fabric sheets increase from the upstream side to the downstream side in the transport direction.

(9) The device for producing a fibrous sheet disclosed in any one of (1) to (8), wherein the water squeezing section has a solvent application unit which applies a solvent for forming cavities in the fibrous sheet to the web substrate.

Effects of the Invention

According to the present invention, because the plurality of first fabric sheets are arranged longitudinally, when the dispersion medium is squeezed from the dispersion, the frictional force that acts on the first fabric sheets can be dispersed across the plurality of first fabric sheets. As a result, the first fabric sheets can be run without pulling the first fabric sheets with a strong tension. Accordingly, a fibrous sheet can be produced while preventing slipping and damage of the first fabric sheets.

Further, because the continuous sheet is positioned so as to extend over the upper surface of the plurality of first fabric sheets, in the water squeezing section, the frictional force during squeezing causes the lower surface of the continuous sheet and the upper surfaces of the first fabric sheets to adopt a state of close contact. When the first fabric sheets are run in this state, the continuous sheet is transported by the first fabric sheets. As a result, the continuous sheet can be transported without having to pull the continuous sheet with a strong tension. Accordingly, a fibrous sheet can be produced while preventing slipping and damage of the continuous sheet.

Moreover, according to this device configuration, the web substrate that is partway through web generation is transported between the plurality of first fabric sheets in a state mounted on the upper surface of the continuous sheet, and therefore damage of the web substrate during transfer between the plurality of first fabric sheets can be avoided. Accordingly, a fibrous sheet formed from fine fibers can be produced reliably.

EMBODIMENTS FOR CARRYING OUT THE INVENTION

First Embodiment

Figure 1:
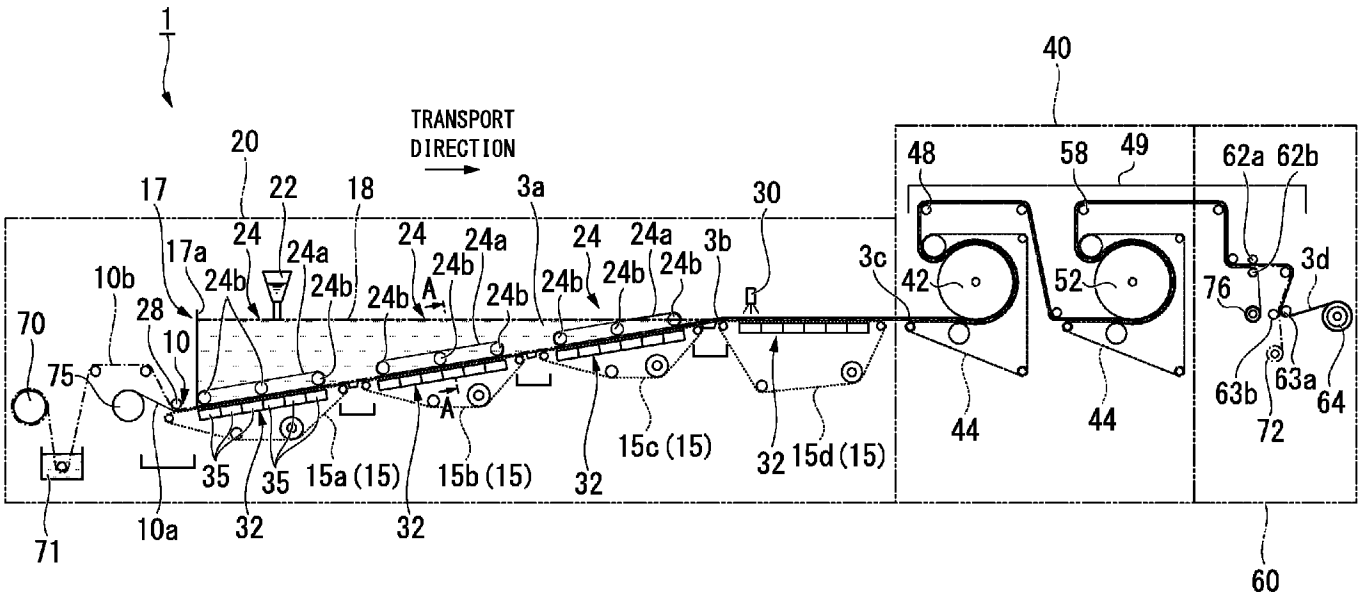
FIG. 1 is a schematic structural diagram of a device 1 for producing a fibrous sheet according to a first embodiment.

A device for producing a fibrous sheet according to a first embodiment of the present invention is described below with reference to the drawings.

The present embodiment relates to a device for producing a fibrous sheet from a dispersion containing fine fibers. The fibrous sheet is composed of an aggregate of the fine fibers (in the form of a nonwoven fabric or paper). Nanofiber cellulose (NFCe) obtained by mechanically grinding and refining a pulp can be used as the fine fibers.

Specifically, examples of the raw material include plant-derived cellulose, animal-derived cellulose and bacteria-derived cellulose, more specific examples include chemical pulp fibers obtained by digesting softwood or hardwood by the Kraft method, sulfite method, soda method or polysulfite method or the like, mechanical pulp fibers obtained by performing pulping using the mechanical force of a refiner or grinder or the like, semi-chemical pulp fibers obtained by performing a pretreatment using a chemical agent and then performing pulping using mechanical force, and recycled paper pulp fibers, and each of these fibers can be used in either an unbleached state (prior to bleaching) or a bleached state (following bleaching). Further, examples of non-timber-based pulps produced from herbaceous species include pulped fibers obtained from cotton, Manila hemp, linen, straw, bamboo, bagasse and kenaf and the like using the same methods as those used for timber pulps.

Examples of tree species used for the aforementioned pulp include softwood trees such as Douglas fir, Japanese red pine, Japanese black pine, Sakhalin fir, Jezo spruce, Oregon pine, Japanese larch, fir, hemlock fir, Japanese cedar, Japanese cypress, Veitch's fir, Hondo spruce, cypress, Douglas fir, hemlock, white fir, spruce, balsam fir, cedar, pine, Sumatran pine and radiata pine, and hardwood trees such as beech, birch, alder, oak, laurel, Japanese stone oak, Japanese white birch, cottonwood, poplar, ash, Japanese poplar, eucalyptus, mangrove and lauan. Further, various hemps, mitsumata plants, bamboo and straw can also be pulped and used.

Then, by subjecting the pulp to a mechanical treatment such as a refiner treatment to shorten the fibers, subsequently subjecting the shortened fiber pulp to a treatment with a cellulase-based enzyme, and then performing a refining treatment with a high-speed rotational defibrator or a high-pressure homogenizer, a nanofiber cellulose can be obtained.

The dispersion is prepared by dispersing the fine fibers in a dispersion medium composed of water, an organic solvent, or a mixed liquid containing water and an organic solvent.

Nanofiber cellulose is a cellulose fiber or a rod-shaped particle of cellulose having a far narrower width than a pulp fiber used in typical paper manufacturing applications. The nanofiber cellulose is an aggregate of cellulose molecules in a crystalline state, and the crystal structure thereof is the I-type (parallel chain). The width of the nanofiber cellulose when viewed under a scanning electron microscope (SEM) is preferably from 2 nm to 1,000 nm, more preferably from 2 nm to 500 nm, and still more preferably from 4 nm to 100 nm. If the width of the fiber is less than 2 nm, then the cellulose dissolves in water as cellulose molecules, and therefore the cellulose is unable to exhibit the physical properties (strength, rigidity, and dimensional stability) of a fine fiber. If the width of the fiber exceeds 1,000 nm, then because the cellulose cannot be called a fine fiber, and is simply the type of fiber included in ordinary pulp, the physical properties (strength, rigidity, and dimensional stability) of a fine fiber cannot be obtained. Furthermore, in the case of an application that requires transparency in a composite of the nanofiber cellulose, the width of the fine fibers is preferably not more than 50 nm. In other words, the width of the aforementioned fine fibers is preferably from 2 nm to 50 nm, and more preferably from 4 nm to 50 nm.

Further, the fiber length of the nanofiber cellulose in the present embodiment (the weighted average fiber length measured in accordance with Japan TAPPI paper pulp test method No. 52:2000) is preferably from 1 to 1,000 μm, more preferably from 10 to 600 μm, and particularly preferably from 50 to 300 μm. The aspect ratio, which is the value obtained by dividing the fiber length by the fiber width, is preferably from 100 to 30,000, more preferably from 500 to 15,000, and particularly preferably from 1,000 to 10,000.

If a fibrous sheet is produced from these types of fine fibers, then the thickness of the fibrous sheet can be reduced and the porosity can be increased, and the pore diameter can also be reduced. If this fibrous sheet is employed as the separator of an electrical storage device, then the electrical storage performance of the electrical storage device can be improved.

FIG. 1 is a schematic structural diagram of a device 1 for producing a fibrous sheet according to the present embodiment. In FIG. 1, the transport direction of a web substrate 3*b* is defined as being from left to right, wherein the upstream side is the left side and the downstream side is the right side.

The device 1 for producing a fibrous sheet includes a water squeezing section 20 which squeezes a dispersion medium from a dispersion 3*a* containing fine fibers to generate a web 3*c*, a drying section 40 which dries the web 3*c* to generate a fibrous sheet 3*d*, and a winding section 60 which winds the generated fibrous sheet 3*d*.

(Water Squeezing Section)

The water squeezing section 20 includes a plurality (four in the present embodiment) of first fabric sheets 15 (15*a* to 15*d*) arranged longitudinally in a linear manner, and a continuous sheet 10 which is positioned so as to extend over the top of the first fabric sheets 15 (15*a* to 15*d*).

Figure 2:
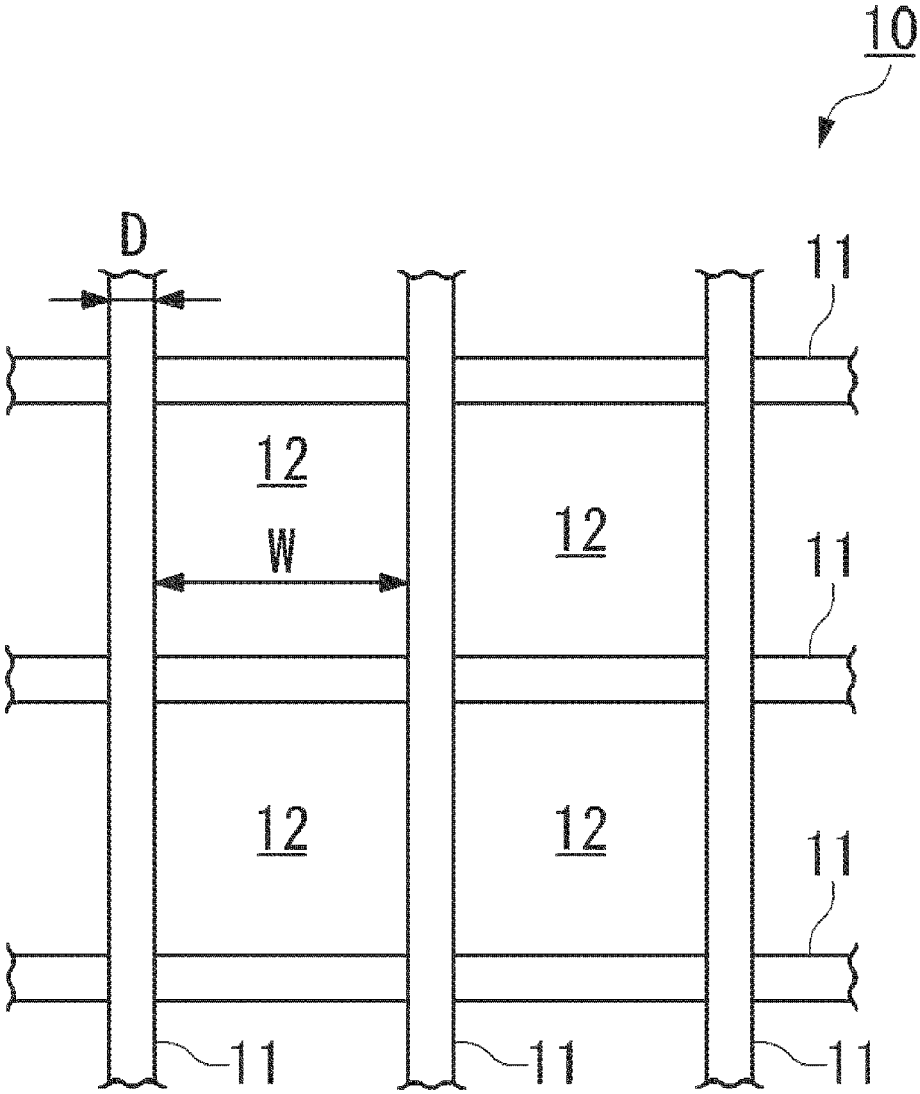
FIG. 2 is an enlarged view of a fabric sheet when viewed from the normal direction.

FIG. 2 is an enlarged view of a fabric sheet when viewed from the normal direction. The first fabric sheets 15 are formed by interweaving a wire material 11 formed from a metal such as stainless steel or a plastic such as polyester or nylon into a mesh-like form.

The wire diameter D of the wire material 11 that constitutes the first fabric sheets 15 is preferably from Ø50 to 1,000 μm, more preferably from 70 to 500 μm, and particularly preferably from 90 to 400 μm. If the wire diameter D is less than 50 μm, then the strength decreases, and the tension cannot be raised. If the wire diameter D exceeds 1,000 μm, then the unevenness becomes too great, and there is a possibility that this unevenness may be transferred to the fibrous sheet, causing roughening of the sheet surface. A specific example of the wire diameter D is Ø200 μm. Further, the mesh aperture dimension W of the mesh pores 12 of the first fabric sheets 15 is preferably from 100 to 5,000 μm, more preferably from 120 to 1,000 μm, and particularly preferably from 140 to 750 μm. If the aperture dimension W is less than 100 μm, then there is a possibility that the dewatering properties may worsen. If the aperture dimension W exceeds 5,000 μm, then the strength decreases, and the tension cannot be raised.

The first fabric sheets 15 extend as endless belts around a plurality of rollers. The first fabric sheets 15 run in a circulatory manner around an orbital trajectory by rotationally driving the rollers with a motor (not shown in the drawings). Then, each of the first fabric sheets 15 is positioned so that the travel direction of the upper circulating portion of the first fabric sheet 15 coincides with the transport direction of the web substrate 3*b*. The travel direction of the upper circulating portions of the first fabric sheets 15 becomes the transport direction for the web substrate 3*b* that is partway through generation of the web 3*c*. In the water squeezing section 20, four first fabric sheets 15*a* to 15*d* are arranged linearly in sequence from the downstream side of the transport direction (the left side in FIG. 1) to the upstream side (the right side on FIG. 1) with a prescribed space therebetween.

Each of the first fabric sheets 15 formed in this manner can be run at a travel speed of 0.05 m/min to 50 m/min. A preferred range for the travel speed of each first fabric sheet 15 is from 0.1 to 50 m/min, and a more preferred range is from 0.5 to 20 m/min.

Here, all or some of the first fabric sheets 15 are preferably arranged with an incline that increases in height from the upstream side toward the downstream side. By inclining the first fabric sheets 15, the web substrate 3*b* can be gently lifted and pulled out from the dispersion 3*a* accumulated in a storage unit 17 described below. Hence, a well-formed fibrous sheet having a smooth surface can be produced. The angle of inclination of the first fabric sheets 15 is preferably from 0.1 degrees to 30 degrees, and particularly preferably from 0.5 degrees to 15 degrees, relative to the horizontal plane.

In the present embodiment, the first fabric sheets 15*a* to 15*c* are installed with an inclination of approximately 1.5 degrees relative to the horizontal plane. In the region where the most downstream first fabric sheet 15*d* is installed, a solvent is applied to the web substrate 3*b* as described below. Accordingly, in order to enable application of the solvent with no irregularities, the most downstream first fabric sheet 15*d* is installed substantially horizontally.

(Continuous Sheet)

In the water squeezing section 20, the continuous sheet 10 extends across the upper surface of each of the first fabric sheets 15*a* to 15*d*. The continuous sheet 10 extends from the water squeezing section 20 across to the drying section 40 described below.

The continuous sheet 10 is formed by superimposing a second fabric sheet 10*a* and a filter material for papermaking 10*b* which is disposed on the upper surface of the second fabric sheet 10*a*.

At the upstream side of the water squeezing section 20, the second fabric sheet 10*a* and the filter material for papermaking 10*b* are supplied from a second fabric sheet supply reel 75 and a papermaking filter material supply reel 70 respectively. Subsequently, the continuous sheet 10 is formed by superimposing the second fabric sheet 10*a* and the filter material for papermaking 10*b* at a base end roller 28 at the upstream side of the water squeezing section 20. In the present embodiment, when supplying the filter material for papermaking 10*b*, the material is passed through an impregnation tank 71 containing stored water, thereby impregnating the filter material for papermaking 10*b* with water. Impregnating the filter material for papermaking 10*b* with water in advance can inhibit the generation of wrinkles in the filter material for papermaking 10*b* when the dispersion medium of the dispersion 3*a* penetrates through the filter material for papermaking 10*b*. Accordingly, a smooth web 3*c* can be formed on the upper surface of the filter material for papermaking 10*b*.

(Second Fabric Sheet)

The second fabric sheet 10*a* is formed by interweaving a wire material 11 formed from a metal such as stainless steel or a resin such as polyester into a mesh-like form in the same manner as the first fabric sheets 15 (see FIG. 2).

Whereas the first fabric sheets 15 are run by driving the rollers with a motor (not shown in the drawings), the second fabric sheet 10*a* is mainly transported by the first fabric sheets 15 in the manner described below. In other words, during operation, the second fabric sheet 10*a* is not subjected to a pulling force provided by rollers as is the case with the first fabric sheets 15, and therefore the second fabric sheet 10*a* does not require the high level of strength of the first fabric sheets 15. Accordingly, the wire material 11 of the second fabric sheet 10*a* can employ a stainless steel wire or plastic wire having a narrow wire diameter and a small mesh aperture.

The wire diameter D of the wire material 11 that constitutes the second fabric sheet 10*a* is typically from Ø10 to 40 μm. Specific examples of the wire diameter D are Ø20 μm and Ø34 μm. Further, the mesh aperture dimension W of the mesh pores 12 of the second fabric sheet 10*a* is typically from 5 to 50 μm. A preferred range for the mesh aperture dimension W of the second fabric sheet 10*a* is from 10 to 40 μm.

(Filter Material for Papermaking)

The filter material for papermaking 10*b* is disposed on the upper surface of the second fabric sheet 10*a*.

The filter material for papermaking 10*b* can use a paper substrate, a nonwoven fabric, a woven fabric, or a membrane filter or the like. Among these, a paper substrate or a nonwoven fabric or woven fabric of fibers of polyester or nylon or the like can be used favorably, but a paper substrate, which exhibits minimal elongation, can easily be produced as a long object and has minimal pores is particularly favorable. There are no particular limitations on the paper substrate, but a smooth paper substrate having air permeability is preferable. Specific examples of the paper substrate include high-quality paper, medium-quality paper, inkjet paper, copy paper, art paper, coated paper, craft paper, paperboard, white paperboard, newspaper and woody paper, but an inkjet paper having a porous coating layer on at least one surface of the paper substrate is preferable. The porous coating layer is a porous layer having a multitude of pores, and may be composed of either a single layer or multiple layers.

Figure 3:
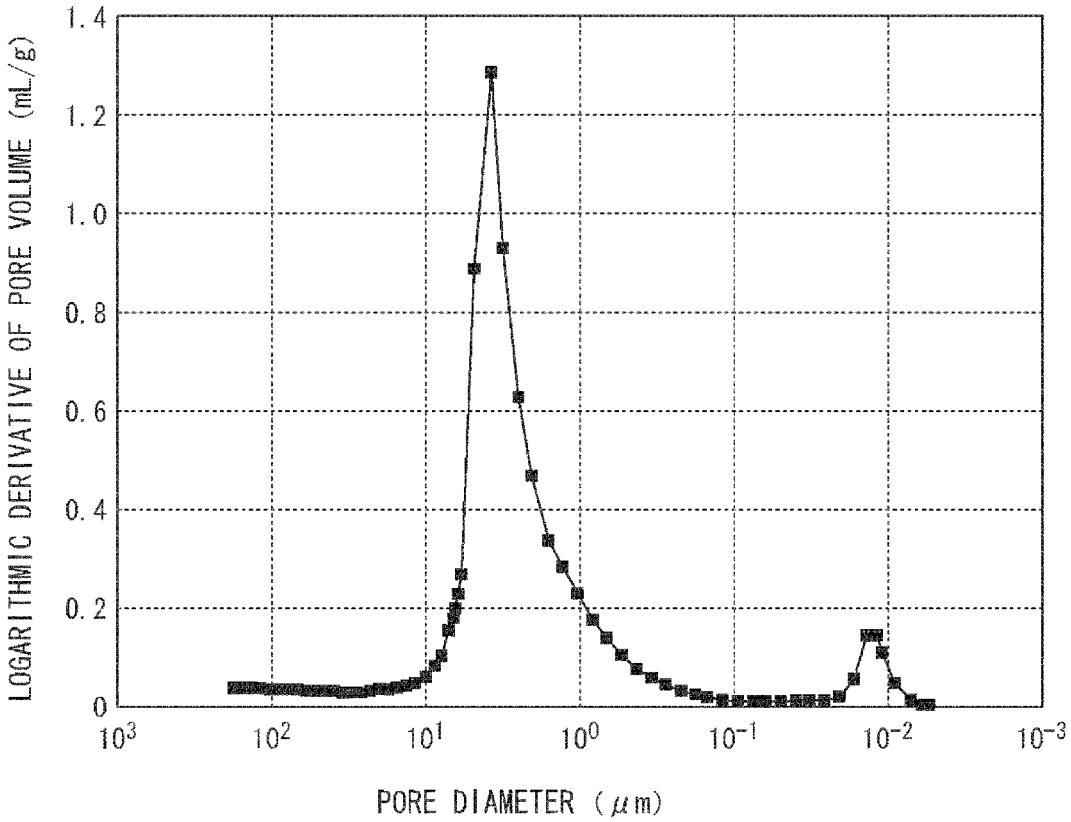
FIG. 3 is a graph illustrating one example of a pore diameter distribution curve for a filter material for papermaking.

FIG. 3 is a graph illustrating one example of a pore diameter distribution curve for a filter material for papermaking.

The pore diameter of the filter material for papermaking 10*b* preferably has, within the pore diameter distribution curve for the porous coating layer of FIG. 3, one or more peaks at both a pore diameter of 0.1 μm or less and a pore diameter within a range from 0.2 to 20 μm. In a porous coating layer having one or more peaks at both a pore diameter of 0.1 μm or less and a pore diameter between 0.2 and 20 μm, it is thought that the nanofiber cellulose is trapped by the small pores having a diameter of 0.1 μm or less, whereas the larger pores having a diameter of 0.2 to 20 μm can improve the permeability of the dispersion medium. Accordingly, the nanofiber cellulose can be trapped satisfactorily, enabling the yield to be further improved, and blockages can also be inhibited, meaning the squeezing time can be shortened. Moreover, by having one or more peaks at both a pore diameter of 0.1 μm or less and a pore diameter between 0.2 and 20 μm, a well-formed fibrous sheet having a smooth surface can be produced.

As illustrated in FIG. 1, the water squeezing section 20 is provided with a die head 22 which discharges the dispersion 3*a* onto the upper surface of the continuous sheet 10, a storage unit 17 which stores the dispersion 3*a* discharged from the die head 22, and side sealing mechanisms 24 that block the gaps G between the side walls 18 of the storage unit 17 (see FIG. 4) and the edges 10*c* of the continuous sheet 10.

As the die head 22, a sealed pressurized head that pressurizes and discharges the dispersion 3*a*, or an open head (for example, a free fall curtain head) that discharges the dispersion 3*a* under its own weight can be used. Further, a spray head that employs so-called liquid pressure atomization, in which the dispersion 3*a* is placed under high pressure and then discharged through a fine nozzle, can also be employed. In FIG. 1, a single die head 22 is provided, but a plurality of die heads 22 may also be provided.

Figure 4:
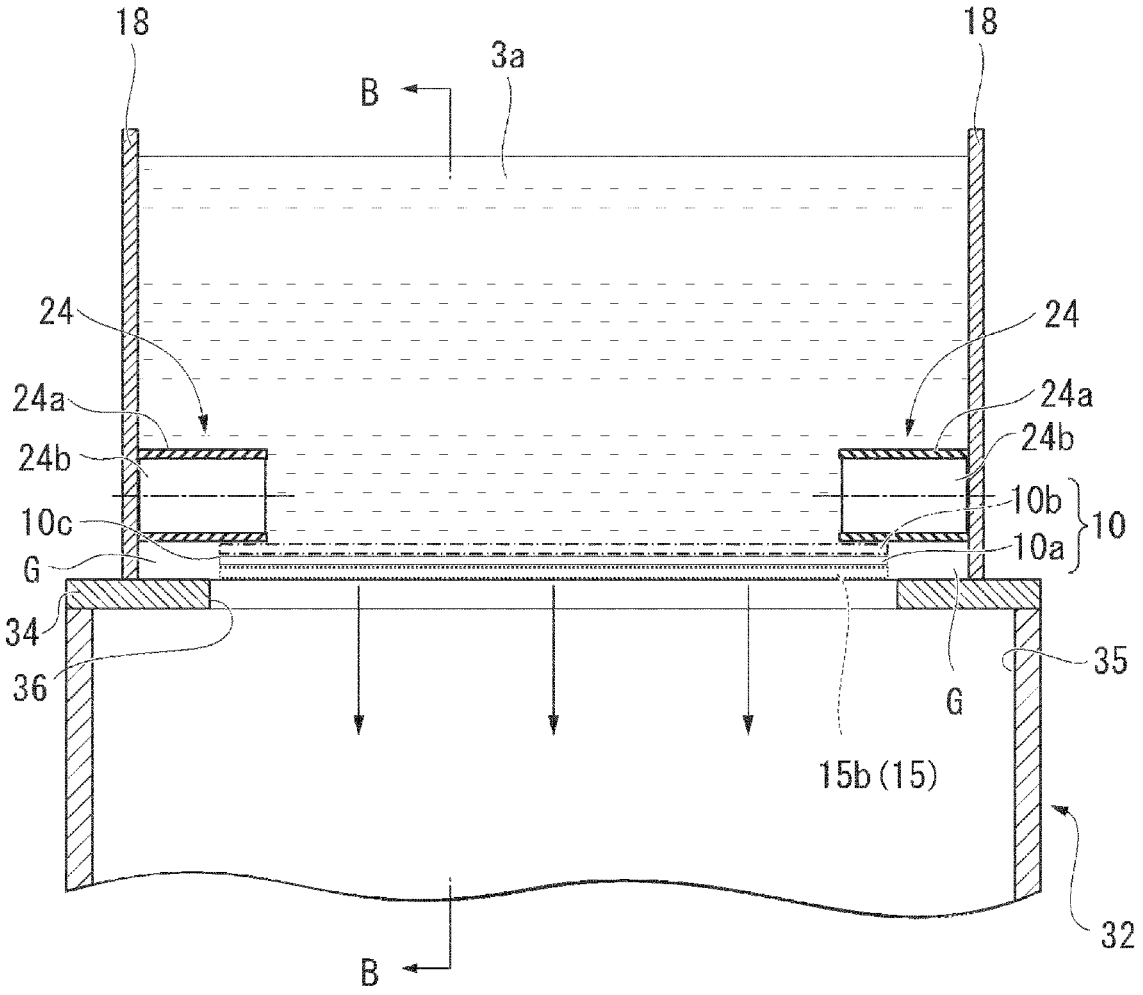
FIG. 4 is a cross-sectional view along the line A-A in FIG. 1.

FIG. 4 is a cross-sectional view along the line A-A in FIG. 1.

As illustrated in FIG. 1 and FIG. 4, the dispersion 3*a* discharged from the die head 22 is stored in the storage unit 17. The storage unit 17 is formed by a region surrounded by the pair of side walls 18, which stand upward facing each other so as to extend along the transport direction at the outside edges 10*c* of the continuous sheet 10 in a direction orthogonal to the transport direction, and an upstream wall 17*a* which stands upward at the upstream side.

The side walls 18 are substantially triangular in shape with the apex at the upstream side, and when viewed from the transport direction, are positioned at the outside of the edges 10*c* of the continuous sheet 10. Further, the upstream wall 17*a* stands at the upstream side of the pair of side walls 18, in a direction orthogonal to the pair of side walls 18.

The first fabric sheets 15 and the continuous sheet 10, which are inclined so that the height increases from the upstream side toward the downstream side (from the left side to the right side in FIG. 1), are disposed at the bottom of the storage unit 17. As a result, the depth of the storage unit 17 becomes gradually shallower from the upstream side toward the downstream side.

(Side Sealing Mechanism)

The side sealing mechanisms 24, which block the gaps G between the side walls 18 of the storage unit 17 and the edges 10*c* of the continuous sheet 10, are provided inside the storage unit 17.

The side sealing mechanism 24 is an endless belt composed of a timing belt 24*a* which is itself an endless belt, and a plurality (three in the present embodiment) of timing pulleys 24*b* which regulate the position of the timing belt 24*a*. The side sealing mechanism 24 is arranged so that the travel direction of the timing belt 24*a* aligns with the travel direction of the continuous sheet 10.

The width of the side sealing mechanisms 24 is formed so as to be wider than the width of the gap G formed between the edge 10*c* of the continuous sheet 10 and the side wall 18 of the storage unit 17. The side sealing mechanisms 24 are installed on top of the edges 10*c* of the continuous sheet 10, and press down on the edges 10*c* of the continuous sheet 10, covering the gaps G, either under their own weight or via pressure application units not shown in the drawings. As a result, the side sealing mechanisms 24 block the gaps G, and prevent leakage of the dispersion 3*a* onto the first fabric sheets 15 and the suction devices 32 from gaps between the edges 10*c* of the continuous sheet 10 and the side walls 18.

Further, the length of the side sealing mechanisms 24 is formed so as to be longer than the length of the suction devices 32 described below. As a result, when the gaps G are blocked, leakage of the dispersion 3*a* onto the suction devices 32 from the edges of the side sealing mechanisms 24 in the travel direction is prevented.

(Water Squeezing Units)

The suction devices 32 (water squeezing units) which suck the dispersion medium are provided beneath the first fabric sheets 15. In the present embodiment, four suction devices 32 are provided, with one device provided beneath each of the first fabric sheets 15*a* to 15*d*. Each suction device 32 has negative pressure chambers 35, and a panel strip 34 which contacts the lower surface of the first fabric sheet 15. A plurality of the negative pressure chambers 35 (six in the present embodiment) are provided in each suction device 32, and a vacuum pump (not shown in the drawings) is connected to the negative pressure chambers 35.

Figure 5:
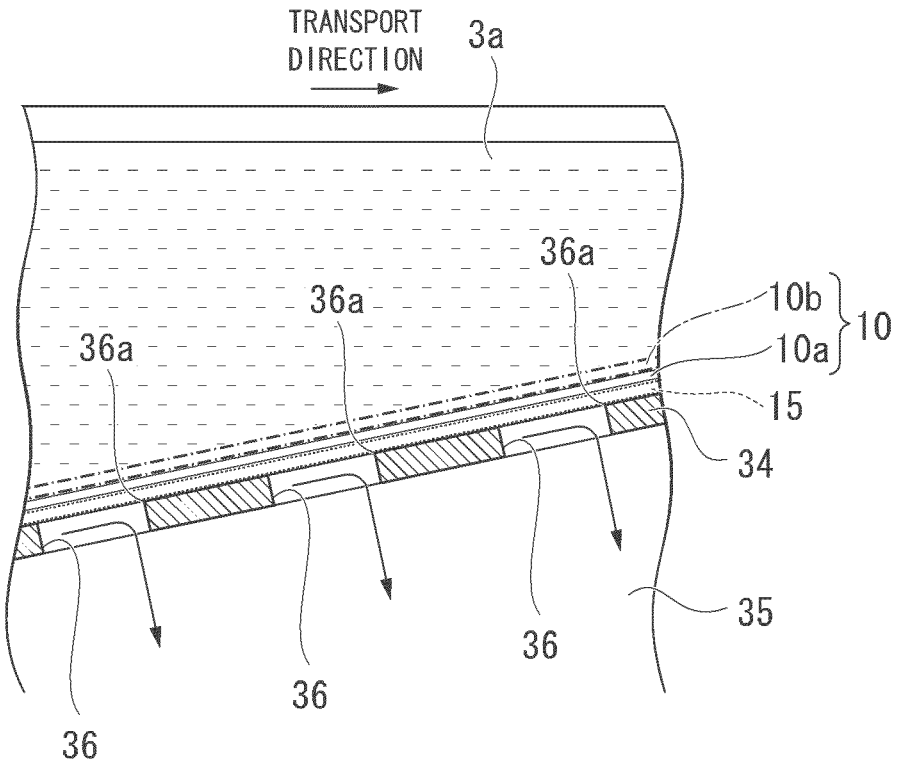
FIG. 5 is a cross-sectional view along the line B-B in FIG. 4.

FIG. 5 is a cross-sectional view along the line B-B in FIG. 4.

As illustrated in FIG. 4 and FIG. 5, the panel strip 34 is a plate-like member in which through-holes 36 are formed for connecting the inside of the suction device 32 with the outside, and is formed from a metal such as aluminum, a resin such as urethane or polyester, or a ceramic such as alumina. The upper surface of the panel strip 34 is provided so as to make contact with the lower surface of the first fabric sheet 15.

The through-holes 36 formed in the panel strip 34 may be formed with all manner of shapes, including substantially circular shapes and slit shapes when viewed from above. The through-holes 36 of the present embodiment are slits which extend in a direction orthogonal to the travel direction of the first fabric sheets 15, and a plurality of these slits are disposed in parallel from the upstream side toward the downstream side. The ratio of the surface area of the openings of the through-holes 36 relative to the surface area of the panel strip 34 (hereafter referred to as the "hole area ratio") is preferably from 0.5 to 60%, more preferably from 2 to 50%, and particularly preferably from 5 to 35%.

When the first fabric sheet 15 is run and the suction pump of the suction device 32 is operated, the insides of the negative pressure chambers 35 and the through-holes 36 adopt a negative pressure. As a result, the dispersion medium contained in the dispersion 3*a* passes through the pores in the continuous sheet 10 and the first fabric sheet 15 and is suctioned through the through-holes 36 of the suction device 32. Moreover, because the upper surface of the panel strip 34 and the lower surface of the first fabric sheet 15 are in contact, the downstream edges 36*a* of the through-holes 36 sweep clean the lower surface of the first fabric sheet 15. In this manner, because the through-holes 36 of the panel strip 34 have a blade function that scrapes off the dispersion medium adhered to the lower surface of the first fabric sheet 15, the suction device 32 can rapidly remove and suction off the dispersion medium that has passed through the pores of the first fabric sheet 15.

As a result of the above, only the fine fibers contained in the dispersion 3*a* remain on the upper surface of the continuous sheet 10 to form the web 3*c*.

Returning to FIG. 1, in the present embodiment, an organic solvent application unit 30 (solvent application unit) is provided which applies an organic solvent (solvent) for forming cavities in the fibrous sheet 3*d* to the top of the first fabric sheet 15*d* positioned at the most downstream side of the device.

The cavities in the fibrous sheet 3*d* are formed by applying and impregnating the organic solvent within the web substrate 3*b*, and then evaporating (drying) the water and the organic solvent in the drying section 40 described below.

Examples of the applied organic solvent include methanol, ethanol, 2-propanol, ethylene glycol-based compounds, glycol ethers such as dipropylene glycol methyl ether, ethylene glycol monobutyl ether, ethylene glycol mono-t-butyl ether and diethylene glycol monoethyl ether, glymes such as diethylene glycol dimethyl ether, diethylene glycol dibutyl ether, tetraethylene glycol dimethyl ether, triethylene glycol dimethyl ether, diethylene glycol diethyl ether, ethylene glycol diethyl ether, ethylene glycol dimethyl ether and diethylene glycol isopropyl methyl ether, dihydric alcohols such as 1,2-butanediol and 1,6-hexanediol, diethylene glycol monoethyl ether acetate, and ethylene glycol monomethyl ether acetate. Combinations of two or more of these organic solvents may also be used.

Among these, ethylene glycol-based compounds, diethylene glycol dimethyl ether and diethylene glycol isopropyl methyl ether, which exhibit excellent solubility in water, and display a good balance between boiling point, surface tension and molecular weight, are particularly preferred as they make it easier to achieve porosity.

Examples of the organic solvent application unit 30 include a spray coater, curtain coater, gravure coater, bar coater, blade coater, size press coater, gate roll coater, cap coater, micro-gravure coater, die coater, rod coater, comma coater and screen coater, but for the reasons of facilitating control of the amount of the organic solvent applied (the impregnation amount) and enabling uniform application (impregnation), at least one method selected from among spray, curtain, gravure, bar, blade and size press coating is preferable. The water-containing web substrate 3*b* has poor strength, and if contact is made with a coater head, then there is a possibility that bands or irregularities may develop in the web substrate 3*b*, and therefore a spray or curtain coating method that has no contact is the most preferable.

(Drying Section)

As illustrated in FIG. 1, the drying section 40 is provided downstream from the water squeezing section 20. In the drying section 40 are provided a first dryer 42 and a second dryer 52 each composed of a cylinder dryer, and felt (blanket) 44 disposed around the outer periphery of both the first dryer 42 and the second dryer 52.

The first dryer 42 and the second dryer 52 are each composed of a cylinder dryer. A cylinder dryer is a device in which a heating medium is introduced into the interior of the cylinder to hold the outer peripheral surface at a high temperature, and the liquid component contained within a sample positioned around the outer peripheral surface is evaporated to dry the sample. A hood 49 is provided so as to cover the drying section 40.

The continuous sheet 10 that emerges from the water squeezing section 20 is wound around the first drier 42 in the drying section 40. The continuous sheet 10 is disposed around approximately ⅔ of the circumference of the outer peripheral surface of the first drier 42. Further, the continuous sheet 10 is then wound from the first drier 42 onto the second drier 52 via a plurality of sub-rollers 48. The continuous sheet 10 is disposed around approximately ⅔ of the circumference of the outer peripheral surface of the second drier 52. The continuous sheet 10 then passes from the second drier 52 via a plurality of sub-rollers 58 into the winding section 60. The first drier 42 and the second drier 52 are designed to rotate at the same angular velocity as the continuous sheet 10 that is disposed around the outer peripheral surfaces of the driers.

The felt 44 is formed from a blanket, and runs in a circulatory manner around the inside of the drying section 40. The felt 44 is positioned outside the continuous sheet 10 in the radial direction of the first drier 42 and the second drier 52. In the same manner as the continuous sheet 10, the felt 44 is disposed around approximately ⅔ of the circumference of the outer peripheral surfaces of the first drier 42 and the second drier 52. The felt 44 is designed to run around the outer peripheral surfaces of the first drier 42 and the second drier 52 at the same angular velocity as the continuous sheet 10.

The web 3*c* that has been introduced into the drying section 40 mounted on the upper surface of the continuous sheet 10 is wound around the outer peripheral surface of the first drier 42 in a state where the upper surface of the web 3*c* contacts the outer peripheral surface of the first drier 42. As a result, the web 3*c*, the continuous sheet 10 and the felt 44 are disposed in sequence, from the inside in the radial direction toward the outside, around the outer peripheral surface of the first drier 42. Because the outer peripheral surface of the first drier 42 is heated to a high temperature, the dispersion medium retained within the web 3*c* evaporates. The evaporated dispersion medium passes through the pores of the continuous sheet 10 and is absorbed by the felt 44. Accordingly, the evaporated dispersion medium can be prevented from re-adhering to the web 3*c*, and therefore the web 3*c* can be dried reliably and efficiently.

Next, the web 3*c* is wound around the outer peripheral surface of the second drier 52. The second drier 52 dries the web 3*c* in a similar manner to the first drier 42, and therefore description of the second drier 52 is omitted. By using a plurality of driers, the web 3*c* can be dried more reliably. The above process completes drying of the web 3*c*, and the fibrous sheet 3*d* is formed.

(Winding Section)

The winding section 60 is provided downstream from the drying section 40. The winding section 60 is equipped with a pair of first separation rollers 62*a* and 62*b* which separate the second fabric sheet 10*a* from the filter material for papermaking 10*b*, and a second fabric sheet recovery reel 76 which recovers the separated second fabric sheet 10*a*.

Further, downstream from the first separation rollers 62*a* and 62*b* are provided a pair of second separation rollers 63*a* and 63*b* which separate the fibrous sheet 3*d* and the filter material for papermaking 10*b*, a papermaking filter material recovery reel 72 which recovers the filter material for papermaking 10*b*, and a winding reel 64 which winds the fibrous sheet 3*d*.

The pair of first separation rollers 62*a* and 62*b* are positioned on either side of the continuous sheet 10. By sandwiching the continuous sheet 10 and the fibrous sheet 3*d* between the pair of first separation rollers 62*a* and 62*b*, the second fabric sheet 10*a* is separated from the filter material for papermaking 10*b* and moves around the surface of one of the first separation rollers 62*b*.

The second fabric sheet recovery reel 76 pulls the second fabric sheet 10*a* away from the surface of the first separation roller 62*b*, and winds the second fabric sheet 10*a*.

The fibrous sheet 3*d*, in a state superimposed with the filter material for papermaking 10*b*, moves around the surface of the other first separation roller 62*a*. Subsequently, by sandwiching the filter material for papermaking 10*b* and the fibrous sheet 3*d* between the pair of second separation rollers 63*a* and 63*b*, the filter material for papermaking 10*b* is separated from the fibrous sheet 3*d* and moves around the surface of one of the second separation rollers 63*b*.

The papermaking filter material recovery reel 72 pulls the filter material for papermaking 10*b* away from the surface of the second separation roller 63*b*, and winds the filter material for papermaking 10*b*.

Further, the winding reel 64 pulls the fibrous sheet 3*d* away from the surface of the other second separation roller 63*a* and winds the fibrous sheet 3*d*. By using this configuration, a fibrous sheet 3*d* in a wound state can be produced.

(Effects of First Embodiment)

According to the present embodiment, because the plurality of first fabric sheets 15*a* to 15*d* are arranged longitudinally, when the dispersion medium is squeezed from the dispersion 3*a*, the frictional force that acts on the first fabric sheets 15*a* to 15*d* can be dispersed across the plurality of first fabric sheets 15*a* to 15*d*. As a result, the first fabric sheets 15*a* to 15*d* can be run without pulling the first fabric sheets 15*a* to 15*d* with a strong tension. Accordingly, a fibrous sheet can be produced while preventing damage of the first fabric sheets 15*a* to 15*d*.

Further, because the continuous sheet 10 is positioned so as to extend over the upper surface of the plurality of first fabric sheets 15*a* to 15*d*, in the water squeezing section 20, the frictional force during squeezing causes the lower surface of the continuous sheet 10 and the upper surfaces of the first fabric sheets 15*a* to 15*d* to adopt a state of close contact. When the first fabric sheets 15*a* to 15*d* are run in this state, the continuous sheet 10 is transported by the first fabric sheets 15*a* to 15*d*. As a result, the continuous sheet 10 can be transported without having to pull the continuous sheet 10 with a strong tension. Accordingly, the fibrous sheet 3*d* can be produced while preventing damage of the continuous sheet 10.

Moreover, according to this device configuration, the web substrate 3*b* that is partway through web generation is transported between the plurality of first fabric sheets 15*a* to 15*d* in a state mounted on the upper surface of the continuous sheet 10, and therefore damage of the web substrate 3*b* during transfer between the plurality of first fabric sheets 15*a* to 15*d* can be avoided. Accordingly, a fibrous sheet 3*d* formed from fine fibers can be produced reliably.

Furthermore, according to the present embodiment, because the continuous sheet 10 is composed of the filter material for papermaking 10*b* disposed on the upper surface of the second fabric sheet 10*a*, by installing a filter material for papermaking 10*b* having smaller pores than the second fabric sheet 10*a*, finer fibers can be trapped. Accordingly, a further reduction in the pore diameter and a further increase in the porosity of the fibrous sheet 3*d* can be achieved.

Further, because the second fabric sheet 10*a* and the filter material for papermaking 10*b* are transported by the first fabric sheets 15*a* to 15*d*, damage of the second fabric sheet 10*a* and the filter material for papermaking 10*b* can be prevented.

Furthermore, according to the present embodiment, because the side sealing mechanisms 24 which block the gaps G between the edges 10*c* of the continuous sheet 10 and the side walls 18 of the storage unit 17 are provided, leakage of the dispersion 3*a* onto the first fabric sheets 15 and the suction devices 32 from the edges 10*c* of the continuous sheet 10 can be prevented. Accordingly, finer fibers can be trapped by the continuous sheet 10, and the dispersion medium can be removed with good efficiency.

Further, according to the present embodiment, because the first fabric sheets 15 are formed as endless belts, the device 1 for producing fibrous sheets can be made more compact.

Moreover, according to the present embodiment, because the continuous sheet 10 extends from the water squeezing section 20 across to the drying section 40, there is no necessity to transfer the web 3*c* from the water squeezing section 20 across to the drying section 40. Accordingly, even if the strength of the web 3*c* weakens due to the use of fine fibers, damage of the web 3*c* during transfer can be avoided, and a fibrous sheet 3*d* formed from fine fibers can be produced reliably.

Further, according to the present embodiment, because the panel strips 34 having the through-holes 36 contact the lower surfaces of the first fabric sheets 15, when the first fabric sheets 15 are run, the lower surfaces of the first fabric sheets 15 are swept clean by the downstream edges 36*a* of the through-holes 36. As a result, the dispersion medium that has passed through the pores of the first fabric sheets 15 can be rapidly removed, and therefore the squeezing operation can be made more efficient.

Furthermore, according to the present embodiment, because the first fabric sheets 15 are arranged so that the height increases from the upstream side toward the downstream side, the web substrate 3*b* can be gently lifted and pulled out of the deeply accumulated dispersion 3*a* at the upstream side of the storage unit 17. Accordingly, a well-formed fibrous sheet 3*d* having a smooth surface can be produced.

Moreover, according to the present embodiment, because the water squeezing section 20 has a solvent application unit which applies an organic solvent that forms cavities in the fibrous sheet 3*d* to the web substrate 3*b*, a porous fibrous sheet 3*d* can be produced.

Second Embodiment

Next is a description of a device for producing a fibrous sheet according to a second embodiment.

Figure 6:
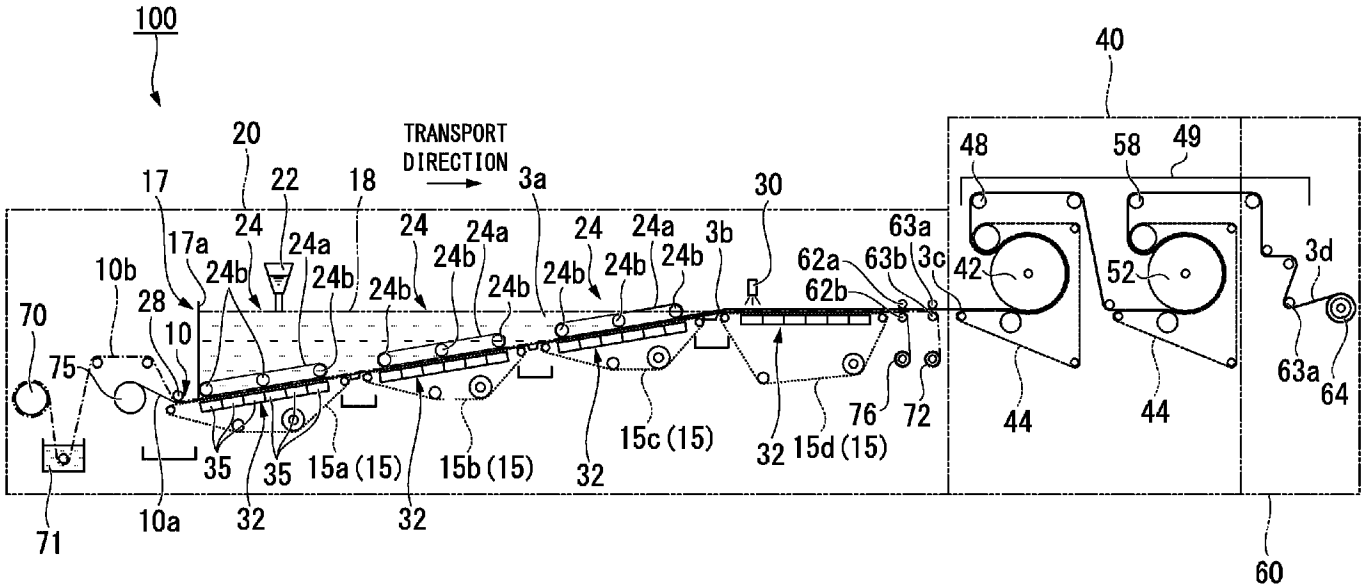
FIG. 6 is an explanatory diagram of a device for producing a fibrous sheet in a second embodiment.

FIG. 6 is an explanatory diagram of a device 100 for producing a fibrous sheet in the second embodiment.

In the device 1 for producing a fibrous sheet according to the first embodiment, the web 3*c* was transferred from the water squeezing section 20 to the drying section 40 while still mounted on top of the continuous sheet 10.

In contrast, the device 100 for producing a fibrous sheet according to the second embodiment differs in that the continuous sheet 10 is recovered at the downstream side of the water squeezing section 20, so that only the web 3*c* is transferred between the water squeezing section 20 and the drying section 40. Detailed descriptions are omitted for those structural components that are the same as the first embodiment.

As illustrated in FIG. 6, the pair of first separation rollers 62*a* and 62*b*, and the pair of second separation rollers 63*a* and 63*b* are provided on the downstream side of the water squeezing section 20, and on the upstream side of the first drier 42 of the drying section 40.

In a similar manner to the first embodiment, by sandwiching the continuous sheet 10 and the web 3*c* between the pair of first separation rollers 62*a* and 62*b*, the filter material for papermaking 10*b* and the second fabric sheet 10*a* are separated, and the second fabric sheet 10*a* moves around the surface of one of the first separation rollers 62*b*.

The second fabric sheet recovery reel 76 pulls the second fabric sheet 10*a* away from the surface of the first separation roller 62*b*, and winds the second fabric sheet 10*a*.

The web 3*c*, in a state superimposed with the filter material for papermaking 10*a*, moves around the surface of the other first separation roller 62*a*.

Subsequently, in a similar manner to the first embodiment, by sandwiching the filter material for papermaking 10*b* and the web 3*c* between the pair of second separation rollers 63*a* and 63*b*, the web 3*c* and the filter material for papermaking 10*b* are separated, and the filter material for papermaking 10*b* moves around the surface of one of the second separation rollers 63*b*.

The papermaking filter material recovery reel 72 pulls the filter material for papermaking 10*b* away from the surface of the second separation roller 63*b*, and winds the filter material for papermaking 10*b*.

The web 3*c* moves alone around the surface of the other second separation roller 63*a*.

Subsequently, the web 3*c* runs alone around the outer peripheral surfaces of the first drier 42 and the second drier 52.

The web 3*c* is wound around the outer peripheral surface of the first drier 42 in a state where the upper surface of the web 3*c* contacts the outer peripheral surface of the first drier 42. As a result, the web 3*c* and the felt 44 are disposed in sequence, from the inside in the radial direction to the outside, around the outer peripheral surface of the first drier 42. Next, the web 3*c* is wound around the outer peripheral surface of the second drier 52. The second drier 52 dries the web 3*c* in a similar manner to the first drier 42, and therefore description of the second drier 52 is omitted.

(Effects of Second Embodiment)

In the first embodiment, the continuous sheet 10 composed of the second fabric sheet 10*a* and the filter material for papermaking 10*b*, and the web 3*c* were in a superimposed state when run around the outer peripheral surfaces of the first drier 42 and the second drier 52. As a result, in the drying section 40, the second fabric sheet 10*a* and the filter material for papermaking 10*b* were interposed between the web 3*c* and the felt 44.

In contrast, in the present embodiment, following separation of the second fabric sheet 10*a* and the filter material for papermaking 10*b*, the web 3*c* is run alone around the outer peripheral surfaces of the first drier 42 and the second drier 52. Accordingly, because nothing is interposed between the web 3*c* and the felt 44, the web 3*c* can be dried more rapidly than the first embodiment.

However, in terms of the strength of the continuous sheet 10 during running around the outer peripheral surfaces of the first drier 42 and the second drier 52, the first embodiment is superior.

Third Embodiment

Next is a description of a device for producing a fibrous sheet according to a third embodiment.

Figure 7:
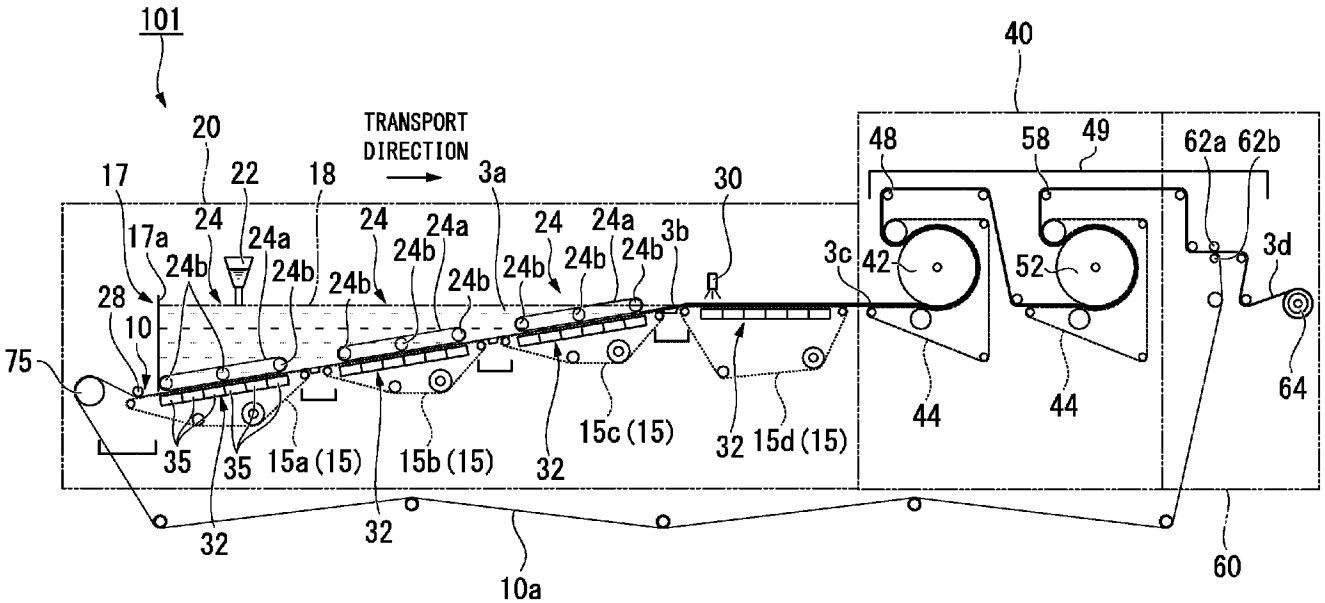
FIG. 7 is an explanatory diagram of a device for producing a fibrous sheet in a third embodiment.

FIG. 7 is an explanatory diagram of a device 101 for producing a fibrous sheet in the third embodiment.

In the device 1 for producing a fibrous sheet according to the first embodiment and the device 100 for producing a fibrous sheet according to the second embodiment, the continuous sheet 10 was formed from the second fabric sheet 10*a* and the filter material for papermaking 10*b*. Further, the second fabric sheet 10*a* and the filter material for papermaking 10*b* were both open-ended belts, supplied from the second fabric sheet supply reel 75 and the papermaking filter material supply reel 70 respectively, and recovered onto the second fabric sheet recovery reel 76 and the papermaking filter material recovery reel 72 respectively.

However, the device 101 for producing a fibrous sheet according to the third embodiment differs from the first embodiment and the second embodiment in terms of the point that the continuous sheet 10 is composed only of the second fabric sheet 10*a*, and the point that the continuous sheet 10 is an endless belt. Detailed descriptions are omitted for those structural components that are the same as the first embodiment and the second embodiment.

As illustrated in FIG. 7, the continuous sheet 10 of the present embodiment is composed of the second fabric sheet 10*a*, and extends from the end roller 75 positioned at the upstream side of the water squeezing section 20 through to the pair of first separation rollers 62*a* and 62*b* provided at the downstream side of the second drier 52. Further, following passage between the pair of first separation rollers 62*a* and 62*b*, the continuous sheet 10 passes across a plurality of ancillary rollers disposed beneath the device and back to the second fabric sheet supply reel 75. In other words, the continuous sheet 10 is an endless belt. The continuous sheet 10 runs in a circulatory manner around an orbital trajectory by using a motor (not shown in the drawing) to rotationally drive the rollers over which the continuous sheet 10 extends.

(Effects of Third Embodiment)

According to this embodiment, because the continuous sheet 10 is formed from only the second fabric sheet 10*a*, and the continuous sheet 10 is formed as an endless belt, there is no necessity to provide a reel for supplying the continuous sheet 10 or a reel for recovering the continuous sheet 10. Accordingly, the device 101 for producing a fibrous sheet can be made more compact.

Further, when travelling around the outer peripheral surfaces of the first drier 42 and the second drier 52 during drying, because only the second fabric sheet 10*a* is interposed between the web 3*c* and the felt 44, the web 3*c* can be dried more rapidly than the first embodiment.

However, in the first embodiment and the second embodiment, installing the filter material for papermaking 10*b* with small pores on the upper surface of the second fabric sheet 10*a* enables fine fibers to be trapped in the water squeezing section, and therefore in terms of enabling a reduction in the pore diameter of the fibrous sheet and an increase in the porosity, the first embodiment and the second embodiment are superior.

This invention is not limited to the embodiments described above.

In each of the devices 1, 100 and 101 for forming fibrous sheets according to the embodiments, four first fabric sheets 15 are provided, but the number of first fabric sheets 15 is not limited to this number.

Further, in each of the embodiments, four suction devices 32 are provided, and six negative pressure chambers 35 are provided within each suction devices 32, but the numbers of suction devices 32 and negative pressure chambers 35 are not limited to these numbers.

In each of the devices 1, 100 and 101 for forming fibrous sheets according to the embodiments, each of the first fabric sheets 15 is an endless belt. However, a supply reel for the first fabric sheet 15 and a recovery reel for the first fabric sheet 15 may be provided, with the first fabric sheet 15 being recovered following running. However, forming the first fabric sheets 15 as endless belts is preferable in terms of making the devices 1, 100 and 101 for forming fibrous sheets more compact.

In the device 100 for producing a fibrous sheet according to the second embodiment, the pair of first separation rollers 62*a* and 62*b* and the pair of second separation rollers 63*a* and 63*b* were disposed on the downstream side of the most downstream first fabric sheet 15*d* and on the upstream side of the first drier 42, and the second fabric sheet 10*a* and the filter material for papermaking 10*b* were recovered at the upstream side of the first drier 42. However, the position for the recovery of the second fabric sheet 10*a* and the filter material for papermaking 10*b* is not limited to this position. Accordingly, for example, the pair of first separation rollers 62*a* and 62*b* may be positioned on the downstream side of the first drier 42 and on the upstream side of the second drier 52, so that the second fabric sheet 10*a* is recovered at the upstream side of the second drier 52.

Further, in a similar manner, the positioning of the second separation rollers 63*a* and 63*b* may also be altered, thus altering the recovery position for the filter material for papermaking 10*b*.

In the device 100 for producing a fibrous sheet according to the second embodiment, only the web 3*c* is run through the first drier 42 and the second drier 52 for drying. Further, in the device 101 for producing a fibrous sheet according to the third embodiment, the second fabric sheet 10*a* and the web 3*c* are run in a superimposed state through the first drier 42 and the second drier 52 for drying. However, the second fabric sheet 10*a* may be separated from the web 3*c* at the upstream side of the first drier 42, so that only the web 3*c* is run through the first drier 42 and the second drier 52 for drying.

INDUSTRIAL APPLICABILITY

According to the present invention, a device for producing a fibrous sheet can be provided that enables production of a fibrous sheet while preventing damage to the fabric sheet.

DESCRIPTION OF THE REFERENCE SYMBOLS

1, 100, 101: Device for producing a fibrous sheet
3*a*: Dispersion
3*b*: Web substrate
3*c*: Web
3*d*: Fibrous sheet
10: Continuous sheet
10*a*: Second fabric sheet
10*b*: Filter material for papermaking
10*c*: Edge
15 (15*a*, 15*b*, 15*c*, 15*d*): First fabric sheet
18: Side wall
20: Water squeezing section
24: Side sealing mechanism
30: Organic solvent application unit (solvent application unit)
32: Suction device (water squeezing unit)
34: Panel strip
36: Through-hole
40: Drying section
G: Gap

The invention claimed is:

1. A device for producing a fibrous sheet from a dispersion containing fine fibers, the device comprising:

a water squeezing section which squeezes a dispersion medium from the dispersion to generate a web, and a drying section which dries the web to generate a fibrous sheet, wherein the water squeezing section has:

a plurality of first fabric sheets arranged longitudinally along a transport direction of a web substrate that is partway through web generation, and water squeezing units which are provided beneath the plurality of first fabric sheets and squeeze the dispersion medium from the dispersion, and in the water squeezing section, a continuous sheet is positioned so as to extend over an upper surface of the plurality of first fabric sheets, wherein the continuous sheet is configured to be transported by the first fabric sheets, and the dispersion is discharged onto an upper surface of the continuous sheet.

2. The device for producing a fibrous sheet according to claim 1, wherein the continuous sheet is a second fabric sheet.

3. The device for producing a fibrous sheet according to claim 1, wherein the continuous sheet is composed of a filter material for papermaking disposed on an upper surface of a second fabric sheet.

4. The device for producing a fibrous sheet according to claim 3, wherein the filter material for papermaking is selected from the group consisting of a paper substrate, a nonwoven fabric, a woven fabric and a membrane filter.

5. The device for producing a fibrous sheet according to claim 3, wherein the filter material for papermaking is a paper substrate selected from the group consisting of high-quality paper, medium-quality paper, inkjet paper, copy paper, art paper, coated paper, craft paper, paperboard, white paperboard, newspaper and woody paper.

6. The device for producing a fibrous sheet according to claim 5, wherein the paper substrate is inkjet paper having a porous coating layer on at least one surface thereof, the porous coating layer having a multitude of pores.

7. The device for producing a fibrous sheet according to claim 6, wherein the pore diameter of the filter material for papermaking has, within the pore diameter distribution curve for the porous coating layer, one or more peaks at both a pore diameter of 0.1 μm or less and a pore diameter within a range from 0.2 to 20 μm.

8. The device for producing a fibrous sheet according to claim 1, wherein the water squeezing section has side walls which stand upward facing each other so as to extend along the transport direction at both outside edges of the continuous sheet in a direction orthogonal to the transport direction, and a side sealing mechanism is provided which blocks gaps between edges of the continuous sheet and the side walls.

9. The device for producing a fibrous sheet according to claim 1, wherein the first fabric sheets are endless belts.

10. The device for producing a fibrous sheet according to claim 1, wherein a drying section which dries the web to generate the fibrous sheet is provided downstream from the water squeezing section, and the continuous sheet extends from the water squeezing section across to the drying section.

11. The device for producing a fibrous sheet according to claim 1, wherein panel strips that contact lower surfaces of the first fabric sheets are provided on an upper side of the water squeezing units, and through-holes are formed in the panel strips.

12. The device for producing a fibrous sheet according to claim 1, wherein the plurality of first fabric sheets in the water squeezing section are arranged so that heights of the first fabric sheets increase from an upstream side to a downstream side in the transport direction.

13. The device for producing a fibrous sheet according to claim 1, wherein the water squeezing section has a solvent application unit which applies a solvent for forming cavities in the fibrous sheet to the web substrate.

14. The device for producing a fibrous sheet according to claim 1, wherein the first fabric sheets are mesh-like form formed from a wire material, the wire diameter of the wire material of the first fabric sheets is from Ø50 to 1,000 μm, the mesh aperture dimension of mesh pores of the first fabric sheets is from 100 to 5,000 μm, the continuous sheet contains a second fabric sheet, the second fabric sheets are mesh-like form formed from a wire material, the wire diameter of the wire material of the second fabric sheets is from Ø10 to 40 μm, and the mesh aperture dimension of mesh pores of the second fabric sheets is from 5 to 50 μm.

* * * * *